US006086023A

United States Patent [19]

Kerr et al.

[11] Patent Number: 6,086,023

[45] Date of Patent: Jul. 11, 2000

[54] PLASTIC BAG RACK

[75] Inventors: Jonathan F. Kerr, Parasdise Valley, Ariz.; Peter D. Dieterich, Jr., Mill Valley, Calif.; Roy K. Fischer, Scottsdale, Ariz.

[73] Assignee: Handle Helper L.P., San Francisco, Calif.

[21] Appl. No.: 09/010,890

[22] Filed: Jan. 22, 1998

[51] Int. Cl.[7] ..... B65B 67/04

[52] U.S. Cl. ..... 248/100

[58] Field of Search ..... 248/95, 97, 99, 248/100, 101; 220/495.11, 407, 410, 404; 383/8; 206/284, 288, 622, 626, 634

[56] References Cited

U.S. PATENT DOCUMENTS

| | | | |
|---|---|---|---|
| 688,238 | 12/1901 | Davis | 248/97 |
| 4,366,916 | 1/1983 | Guido et al. | 248/97 X |
| 4,407,474 | 10/1983 | Swenson | 248/97 |
| 4,487,388 | 12/1984 | Provan | 248/99 X |
| 4,805,857 | 2/1989 | Travis | 248/97 |
| 4,869,447 | 9/1989 | Malik | 248/97 |
| 4,981,216 | 1/1991 | Wilfong, Jr. | 248/97 X |
| 5,020,750 | 6/1991 | Vrooman et al. | 248/97 |
| 5,125,604 | 6/1992 | Vrooman et al. | 248/97 |
| 5,190,253 | 3/1993 | Sable | 248/97 |

FOREIGN PATENT DOCUMENTS

| | | | |
|---|---|---|---|
| 399781 | 7/1909 | France | 248/97 |

*Primary Examiner*—Anita M. King
*Assistant Examiner*—Michael Nornberg
*Attorney, Agent, or Firm*—Flehr Hohbach Test Albritton & Herbert LLP

[57] ABSTRACT

A bag rack (10) including a base (12), side walls (18, 20), a back wall (22) and a pair of L-shaped bag support arms (32). Side walls (18, 20) are releasably joined and secured to back wall (22) by the upright legs (30) of bag support arms (32) by means of a series of interlocking, aligned slots (26, 28). A rear slot (42) is provided between back wall (22) and base (12) to allow the bottom edges of a multiplicity of bags carried by a hook (37) to extend back of base (12).

12 Claims, 5 Drawing Sheets

PLASTIC BAG RACK

TECHNICAL FIELD

This invention relates to bag racks for dispensing and packing of plastic bags, particularly of the T-shirt type.

BACKGROUND ART

Plastic T-shirt bags have largely displaced paper bags over the last twelve years in grocery and other major retail markets. One of the major reasons for the market success of plastic bags, aside from their inherent cost advantage, has been the development of racks to manage the thin, flexible and difficult to control bags. Unlike a paper bag that can stand up on its own while being loaded with groceries, plastic bags initially required a packer to hold the bag up in an open position with one hand and load the groceries with the other hand.

The primary function of early plastic bag racks was to hold the bags suspended over a base in an open position, freeing the packer to use both hands to load the groceries. Following these early racks were numerous bag rack designs that improved the speed with which the bags could be opened, packed and removed. Bag racks were developed that could store and accommodate a flat bundle of unopened bags. Opening of the bags was made easier by perforating both arms of each bag handle and suspending the bags from these perforations by cantilevered arms on each side of the rack. The entire bundle of bags could be pre-loaded onto the cantilevered arms and held in place by hooking the bags to the back of the rack. Opening a bag involved simply pulling the front of the bag forward, as the handles slid along the cantilevered arms. Opening of the bags was made easier still by forming a thin film tab at the top center of the bag which enabled the packer to pull the front of the bag forward and open the bag by merely touching and pulling forward on the tab. Further developments led to connection of a succession of the bags at this tab section so that the removal of the first bag from the rack pulled the tab of the next bag, semi-automating the bag-opening process.

For all their advantages and speed in opening bags, however, plastic bag racks still do little more to improve actual packing of the bag than to suspend the bag in an open position. The thin plastic film bags have no inherent structure for supporting items loaded therein. When loaded improperly or in a random fashion, the bags stand up properly and contain the grocery items only for as long as they are suspended from the rack. When they are removed and placed on the counter or in a shopping cart, the sides are no longer supported and, as a result, they slump down as the groceries shift and lean against the thin sides of the bag that offer no support. To prevent this, store personnel typically under-fill the bags to avoid spilled groceries. Lower item counts per bag lead to higher bagging costs and also waste material.

Plastic bags can be packed to the same capacity as a similarly dimensioned paper bag, and still remain stable in transit, but the items must be carefully placed in the bag. The most important step in packing a plastic bag so that it will be stable when filled to the bag's capacity is the placement of the very first items. These items, which are ideally boxes and other wide items, should be placed up against the interior sides and front and back of the bag to "build the perimeter." Then the base or bottom of the bag can be packed with stable or heavy items such as a beverage six-pack, and smaller, lighter items can then be placed on top in the center.

Such a proper packing procedure requires considerable care because the thin, flexible sides of the bag provide no support for the initial items around the bag's perimeter. Items pushed out to the sides of the bag walls will either slip right off the edge of the rack base or not stand up because there is nothing for them to lean against. If the first item does stand up on its own, pushing the next item up against the opposite side of the bag can topple the first item by the next item pulling the bag in the opposite direction.

Packers can be observed compensating for this tendency of the plastic bags by leaving one hand inside the bag to prevent the first items from falling inward and holding space open in the center of the bag, while reaching for and retrieving the next items with the other hand. Packing with one hand not only slows the bagging process, repetitive leaning and reaching can introduce ergonomic hazards as well. Again, plastic bag racks have made very little real progress in addressing the difficulty inherent in packing thin, flexible, difficult to control bags.

Plastic bags can be packed correctly, but the bagger must use care and learn the physical boundaries or limits of both the bag and base of the rack being used by that particular store. Such careful packing of the bags is seldom accomplished. The situation is exacerbated by the youth and high rates of turnover among store employees hired to pack bags. The demands placed on baggers to get customers through the checkout line result in poorly packed, and therefore under-filled bags. Retailers complain about the under filling of plastic bags and the associated costs, and the plastic bag manufactures respond by generating training materials to counteract improper and under filled bags. The stores are sent well-produced printed materials and videotapes to educate store employees on the proper bagging procedure. The success of these campaigns then depends on busy store managers who must schedule, implement and continually reinforce the training program as new baggers are hired. If these training efforts are begun at all, they are typically abandoned in short order due to the sheer volume of people who go through these positions.

The first racks built to suspend plastic bags in an open position were of sheet metal construction. These sheet metal racks had sharp edges and required manual opening of the bag and hooking the loops over pegs or other loop-holding designs. The sheet metal racks were also awkward to unload as the loops of a full bag had to be unhooked from the pegs. Another disadvantage of the sheet metal racks was their tall parallel sides. When a bagger over-filled a bag, the bag would be difficult to remove due to the friction against the opposed side walls. The sheet metal racks were eventually replaced by racks constructed of formed wire with a solid base of sheet metal or a thick thermoplastic.

The first formed wire racks required manual opening of the bag but did not have the sharp edges of sheetmetal racks and provided the strength and durability necessary for continually used dispensing apparatus. A subsequent generation of racks, which are in predominant use today, are also of the formed wire variety and incorporate cantilevered arms to facilitate easy-opening bags. These wire racks, like their predecessors provided strength but required numerous secondary operations to construct.

Each wire rack has many separate sections of wire which must be bent into shape, then cut to length, crimped welded together, ground at the ends and sometimes the welds, chrome plated, and assembled with a base that also has been cut, drilled, etc. The number of secondary manufacturing operations required to construct these racks have made them costly to produce.

Plastic bag companies are typically forced to provide their racks free of charge to their larger customers. Adding to their cost is the fact that they are cube-shaped with parallel sides which makes nesting impossible and can therefore only be shipped and stored two in a box. A typical store will have eight or more checkouts with two or three bag racks per checkout. Thus, cost is a paramount concern.

Yet another disadvantage of the current formed and welded wire racks is the proliferation of alternative plastic bag sizes in recent years. The initial plastic bags were predominantly the same size as their paper counterparts: ⅙th barrel bags. Many retailers, however, concluded that if their plastic bags were being under-filled anyway, why not use a somewhat smaller, less expensive bag: the ⅐th barrel bag. Still other retailers reasoned that a thicker, larger bag would encourage baggers to fill the bags. This led plastic bag manufacturers to introduce the larger, heavy-gauge "big bag." For a bag rack to function properly, it must suspend the bag so that when the bag is fully opened, the gusseted bottom of the bag rests flat on the base of the rack. The proliferation of bag sizes therefore led to a proliferation of rack sizes. Once a wire rack was formed and welded as a unit, it was dedicated to particular bag size. The bag manufactures were thus forced to stock a multitude of finished bag racks and to replace and discard the expensive racks every time a customer switched to a different bag size.

The current bag racks suffer from other deficiencies as well. Many of the bag racks are mounted to the side of the checkout counter rather than placed on top of the counter in order to conserve space for the flow of groceries as an order is processed. Although some racks have been fashioned with height adjustments, most racks are mounted at a fixed height by their backs in perpendicular orientation to the counter. Some are mounted to the counter by the side of the rack. Either way, once mounted, the racks are inevitably too low for some individuals and too high for others. Further, unlike the bag racks placed on top of the counter, the current bag racks are designed to be mounted in way that allows for no adjustment to the angle that is optimum for a particular individual for retrieving and packing groceries from a particular check stand configuration, which vary greatly in design and configuration.

Even if the rack were specifically made for mounting to a particular check stand, the current designs allow no minor adjustments during the course of a workday. When people are required to perform repetitive motions for long periods of time, it is preferable that they are given the ability to make their own adjustments to their workspace, particularly when numerous individuals utilize the same workspace.

DISCLOSURE OF INVENTION

Briefly described, the bag rack of the present invention includes a base, a back wall extending upwardly from the base, left and right side walls, each extending between the back wall and the base, and a pair of spaced-apart bag support arms for releasably joining the side walls to the back wall. Each bag support arm includes an upper section extending above the base, cantilevered outwardly over the base, in position for support of a T-shirt bag in a distended condition over the base for filling of the bag. The side walls provide structural support to the back wall in order to maintain the bag support arms in position above the base as a bag is filled with items.

According to an aspect of the invention, the side walls and back wall can be repositioned relative to the base in order to provide for efficient stacking of multiple bag racks. Preferably, the side walls and back wall can be positioned generally in the plane of the base in order to create a substantially flat configuration, which greatly simplifies packaging of multiple bag racks for shipment as well as the manufacturing process. The preferred design of the side walls includes a pivotal joint between the side walls and the base, such as a thin-wall line that creates a hinge-like connection.

According to an aspect of the present invention, the side walls, together with the back wall, define a structural template for baggers to easily and quickly position the first items packed in the bag around the interior perimeter of the bag, thereby increasing the speed with which a bagger can properly pack the bag. The side walls are formed in a manner that does not permit the placement of the perimeter items to exceed the internal dimensions of the bag, thereby preventing items pressed against one side of the bag from pulling over items placed on the opposite side of the bag and providing a surface against which the first taller items may lean upright.

According to another embodiment of the present invention, the perimeter of the base adjacent the side walls and back wall is formed with a slight downward slope from the center of the base. When a bag is held by the bag support arms in an open configuration for receipt of items, the downwardly sloping perimeter of the base tilts items placed around the interior perimeter of the bag outwardly, against the side walls and back wall. This holds the perimeter items in place and prevents them from falling over into the bag as subsequent items are placed into the center of the bag.

While the bag rack of the present invention could be provided with a single side wall for support of the back wall, it is preferable that the bag rack include two side walls, each connected to the base and to the back wall.

According to another embodiment of the present invention, the bag rack comprises a base having upwardly turned side edges and an upwardly turned rear edge, a back wall extending upwardly from the base, and a pair of spaced apart bag support arms mounted to the back wall above the base and having lengths cantilevered outwardly from the back wall over the base by a distance sufficient for support of T-shirt bags thereon in a distended condition for filling. The bag support arms have a relatively thin transverse cross section over substantially their entire lengths for sliding receipt of mounting apertures of T-shirt bags thereon to enable positioning and support of a plurality of T-shirt bags on the arms proximate the back wall. The back wall includes an opening adjacent the base for receiving the bottom edges of the plurality of T-shirt bags supported on the bag support arms. The slot allows the bags to be positioned out of the way so they do not interfere with the upwardly turned rear edge as a front bag is loaded.

In one embodiment of the invention, the base of the bag rack could be formed with an upwardly turned front edge that rises sufficiently to provide a packing template for the front of the bag but is preferably lower than the upwardly turned side edges and upwardly turned back edge so as not to interfere with the typical forward sliding removal of a full bag.

According to another aspect of the present invention, certain components of the bag rack, preferably the bag support arms and the back wall, would be interchangeable with similar components of a different dimension in order to easily adapt the rack to accommodate different sized bags.

In one embodiment of the invention, the base and back wall are made of a structural plastic material while the bag support arms are made from a metal material.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
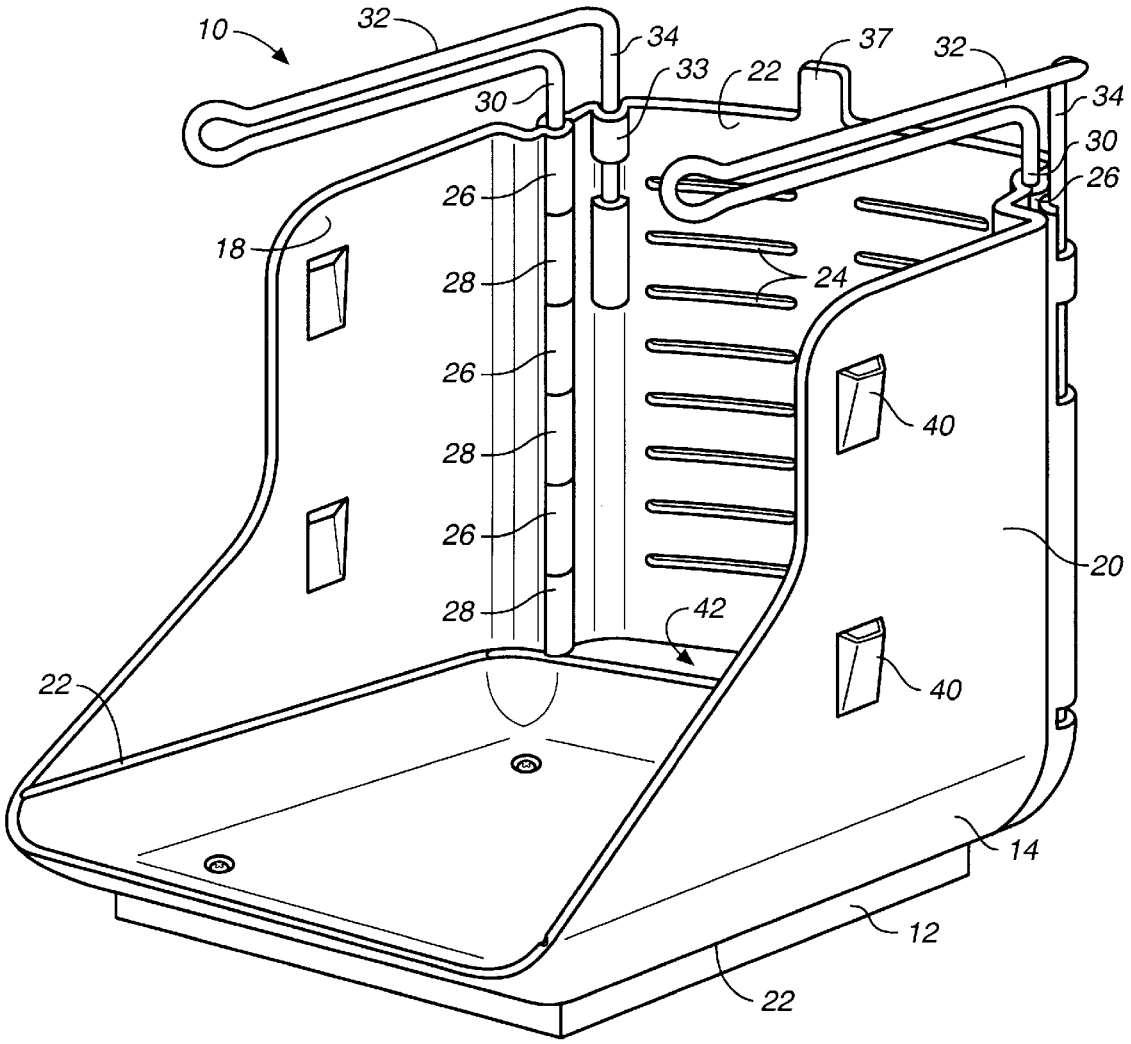
FIG. 1 is a pictorial view of the T-shirt bag rack dispenser of the present invention.

Referring to FIG. 1, the bag rack 10 of the present invention includes a rectangular base 12 having upwardly turned side edges 14, an upwardly turned back edge 16, and an upwardly turned front edge 17 that is formed lower than side edges 14.

Bag rack 10 includes a pair of left and right side walls 18, 20 and a detachable back wall 22. Preferably, side walls 18, 20 are formed monolithically with base 12, with thin wall hinges 22 formed at the upper edges of side edges 14, which allow side walls 18, 20 to fold from an upward position, as shown in FIG. 1, to a substantially flat orientation for stacking.

Forming side walls 18, 20 monolithically with base 12 in a substantially flat orientation and separately forming the substantially flat back wall 22, rather than forming these elements together in a cubic configuration, also simplifies the manufacturing process and obviates the need for costly injection molding slides.

Side walls 18, 20 are formed so that they are not precisely parallel with each other, but rather diverge outwardly so that the space between them is slightly greater at the front of base 12, opposite back wall 22. This ensures that a plastic bag that is overstuffed with items in a manner where the items press against the side walls, can slide outwardly as the bag is released from the bag rack.

Detachable back wall 22 includes a series of slots 24 which are used for mounting the back wall to a fixed support structure at a check-out counter. Slots 24 allow for the rotation of bag rack 10 about its support to enhance the ergonomics of the T-shirt bagging procedure for different store personnel and checkout counter configurations. For example, left-handed and right-handed baggers may wish to have the bag rack oriented at slightly different angles to simplify bagging. Slots 24 are discussed in more detail with reference to FIG. 6

Figure 2:
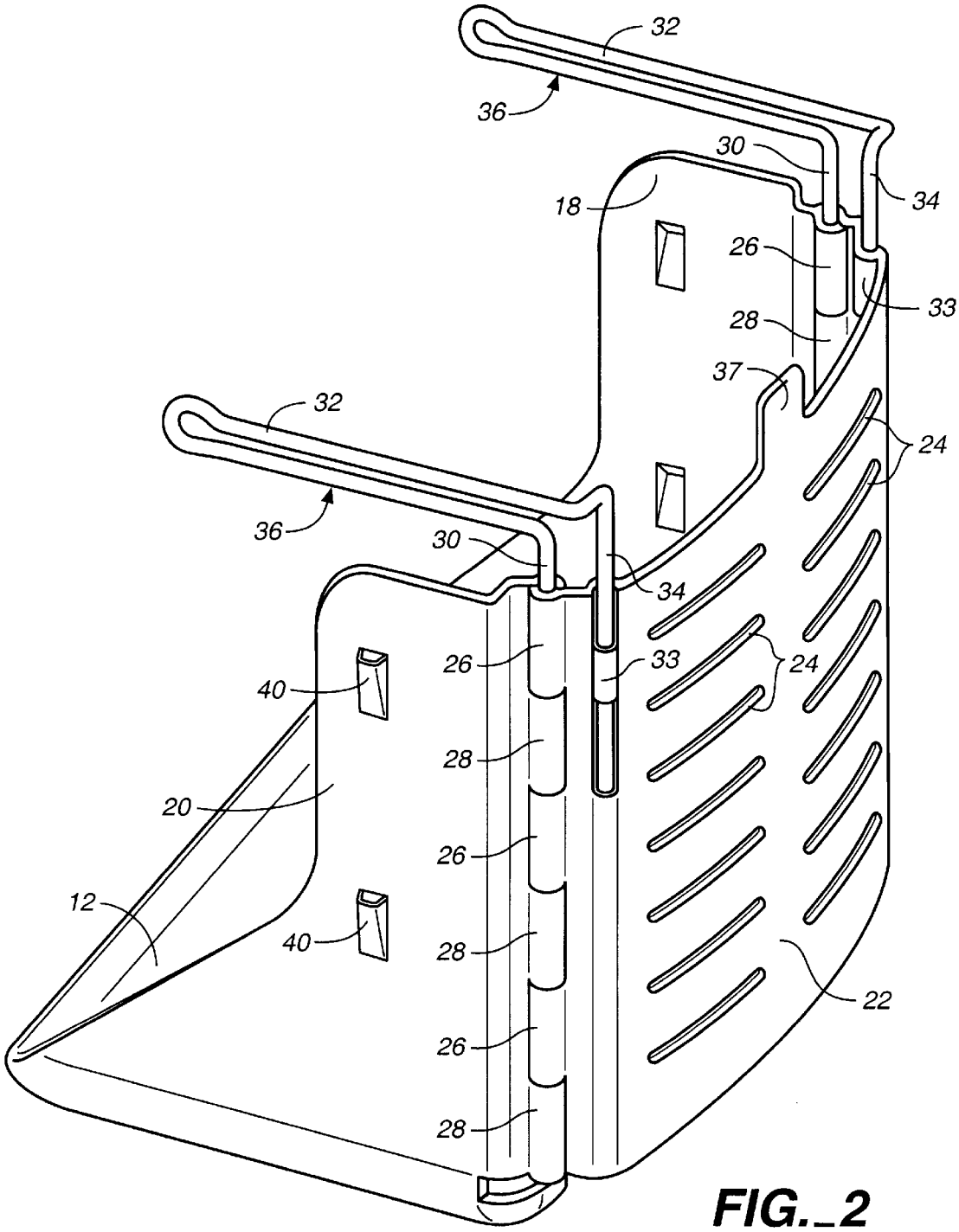
FIG. 2 is a pictorial view of the back side of the bag rack of FIG. 1.

As shown in FIGS. 1 and 2, both side walls 18, 20 and back wall 22 include hinge-like connector elements 26,28 that, when joined and aligned with each other at the rear comers of the bag rack, provide for the reception of the forward upright legs 30 of a pair of L-shaped bag support arms 32. Upright legs 30 alternately extend through cylindrical elements 26 of back wall 22 and cylindrical elements 28 of side walls 18,20. Additionally, back wall 22 includes formed cylindrical slot elements 33 adjacent each rear corner for the reception of a second, rear upright leg 34 of each bag support arm 32. The forward upright legs 30 of bag support arms 32 releasably join and secure side walls 18,20 to back wall 22, while rear upright legs 34 provide added support for bag support arms 32.

Each bag support arm 32 includes an upper rod-formed section 36, which extends above base 12, cantilevered outwardly over the base, and in position for support of T-shirt bags in a distended condition over the base for filling of the bags. The rod-like extensions of upper sections 36 are sufficiently narrow to insert into holes in the looped handles of T-shirt bags and thereby support the bags for filling with items while held by bag rack 10.

Back wall 22 includes a center tab or hook 37 for receiving perforated tabs provided at the upper edge of each T-shirt bag. Hook 37 allows a multiplicity of bags to be mounted onto bag rack 10 in a manner where one bag at a time can be separated from the stack of bags supported by hook 37 and arms 32 and subsequently filled with items.

The side walls 18, 20 provide structural support to back wall 22 in order to maintain bag support arms 32 in position above base 12 as a bag is filled with items. Side walls 18, 20 are formed to allow access beneath the upper sections 36 of bag support arm 32 sufficient to grasp the looped handles of a suspended T-shirt bag in order to remove the bag. The particular design of side walls 18, 20 can vary from that shown, so long as the side walls extend between the base and the back wall and are designed to support the back wall in a manner that maintains the bag support arms in position above the base for receipt and support of T-shirt bags.

Side walls 18, 20, together with the base 12 and back wall 22, define a somewhat confined space or defined area for receiving a bag filled with items. The side walls function to limit formation of the base of the T-shirt bag beyond the edges of the base. In other words, the side walls limit the shape and size of the bag, as it is filled with items, to the size of the base and thereby support items loaded within the bags in a manner that promotes efficient full loading of the bags.

When mounted to side walls 18, 20, back wall 22 defines a wide slot-like opening 42 adjacent the base for receiving the bottom edges of the plurality of T-shirt bags supported on the bag support arms and held by hook 37. Opening 42 allows the bottom edges of stacked bags to be positioned out of the way so as not to interfere with upwardly turned back edge 16 and bag loading.

Side walls 18, 20 include additional formed supports 40 for mounting additional items to bag rack 10, such as bag handle dispensers of the type disclosed in my co-pending patent application entitled "Dispenser For Dispensing Bag Holders," Ser. No. 08/642,355, filed May 3, 1997. Supports 40 can also accommodate holding devices for smaller plastic bags, such as frozen food bags as well as point of sale advertising placards.

Figure 3:
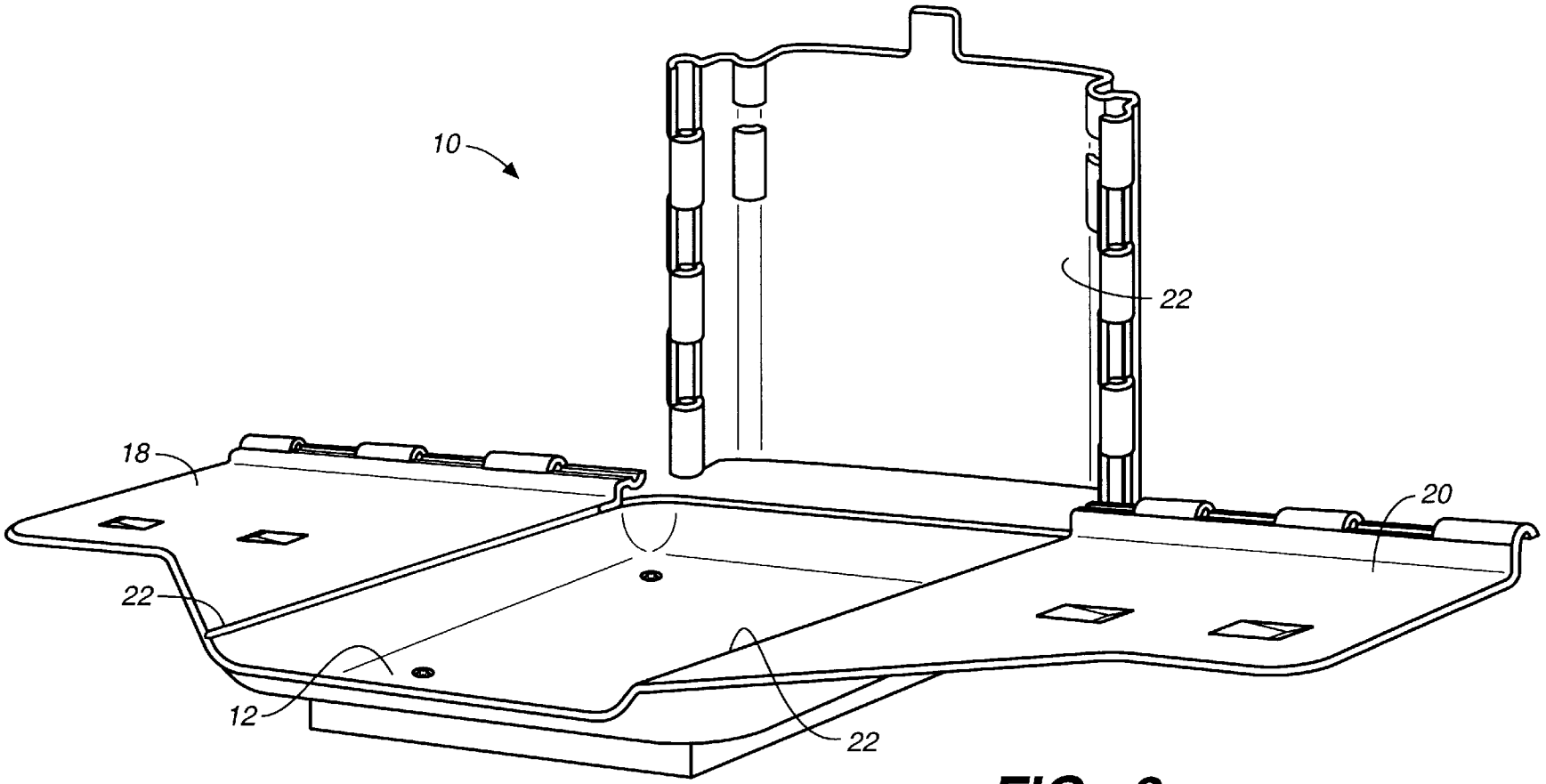
FIG. 3 is a disassembled pictorial view of the bag rack of FIG. 1 with the side walls thereof in a folded down position.

Referring to FIG. 3, bag rack 10 is shown in a disassembled condition, with the bag support arms not shown and with side walls 18,20 in a folded down position so that the base 12 and side walls 18, 20 are in a substantially flat configuration.

Figure 4:
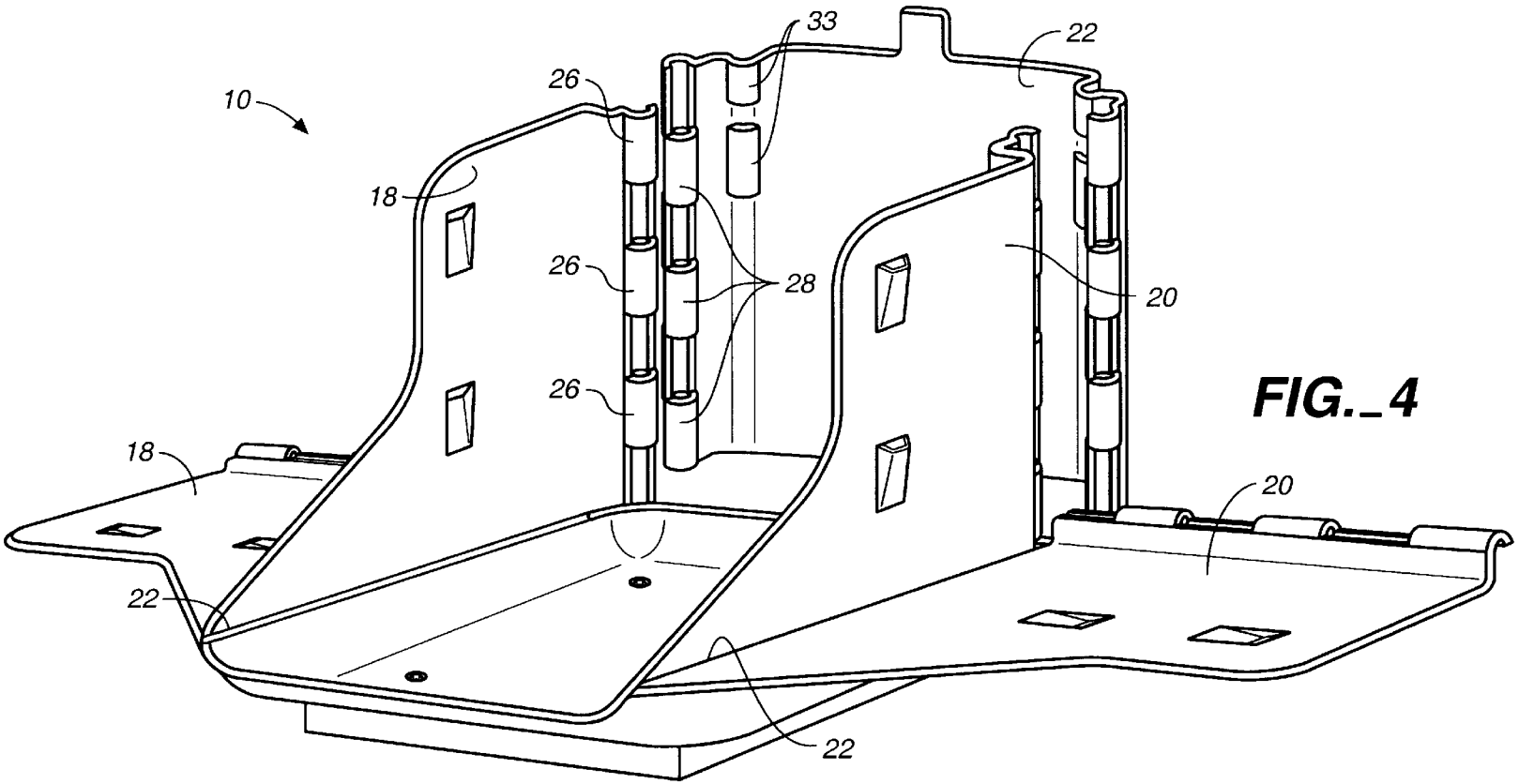
FIG. 4 is a pictorial view like FIG. 3 with the side walls folded upwardly.

As shown in FIG. 4, side walls 18, 20 can be folded upwardly to align with back wall 22 with hinge elements 26,28 aligned for the receipt of an upright leg of the bag support arms.

Figure 5:
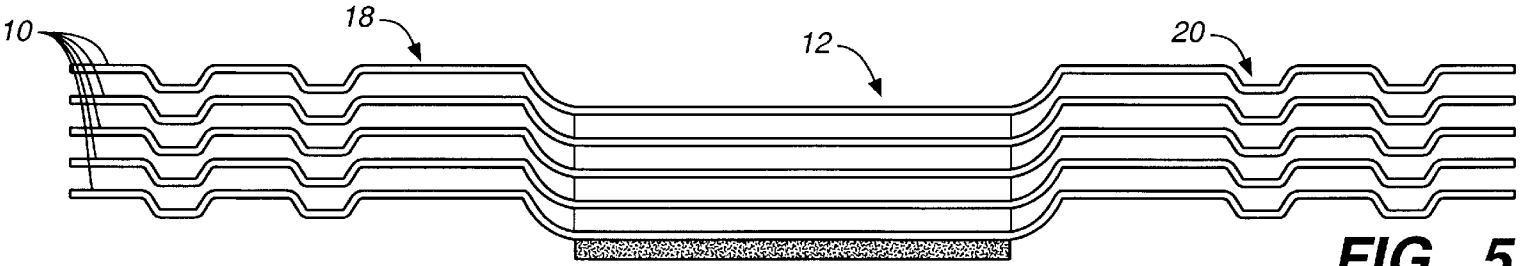
FIG. 5 is a cross-sectional view of several bag racks in an unfolded, stacked configuration, each bag rack shown as taken along the line 7—7 of FIG. 3.

As shown in FIG. 5, in their folded down, flat configuration, side walls 18, 20 and base 12 can be stacked in an efficient configuration for shipment to retail markets. In addition, back walls 22 also can be stacked separately for a similar efficient packaging.

Figure 6:
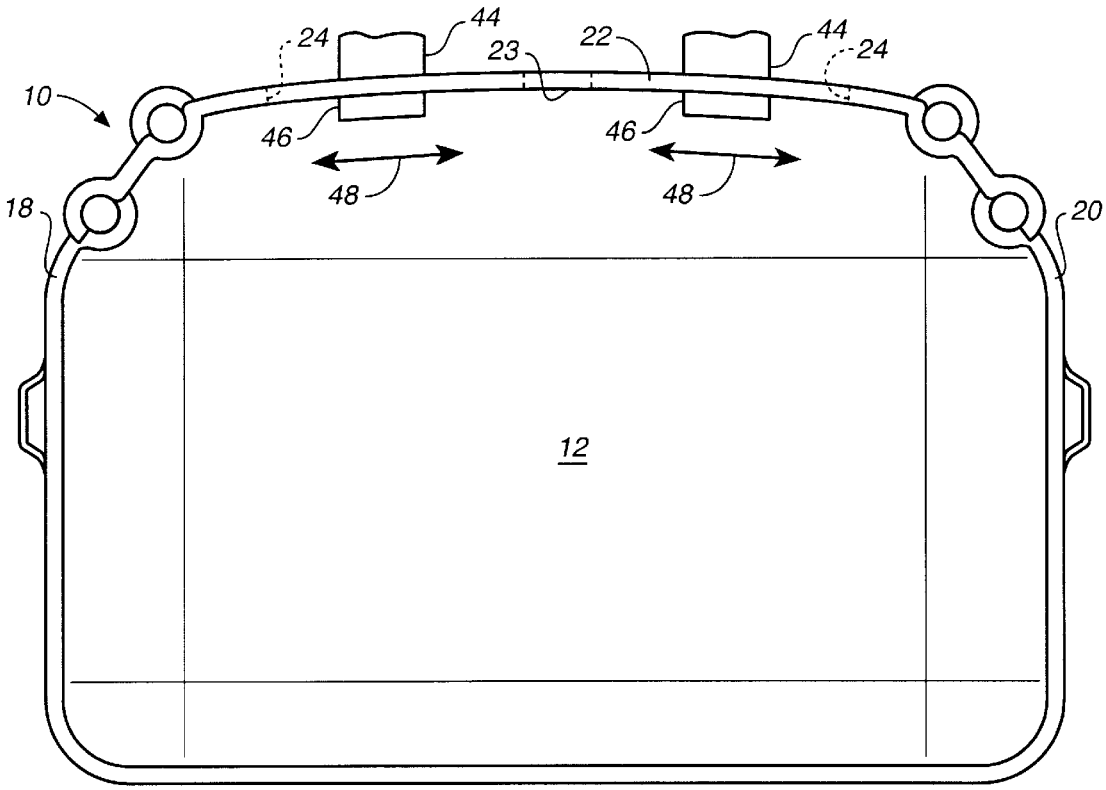
FIG. 6 is a plan view of the bag rack of FIG. 1 shown mounted on a pair of bag rack supports.

FIG. 6 shows a plan view of bag rack 10 mounted on a pair of bag rack mounts 44, which are mounted to a fixed part of a check out counter. Bag rack mounts 44 include upwardly turned front edges 46, which extend through slots 24 of back wall 22 and are upwardly turned so that they press against the inside surface of back wall 22 and thereby retain the bag rack on the mounts. Back wall 22 is arc-shaped, as represented by arc 23. Slots 24 in the arc-shaped portion of back wall 22 allow for repositioning of bag rack 10 relative to bag rack mounts 44 so that the alignment of the bag rack with a person loading items into bags held by the bag rack can be optimized in an ergonomic sense. Arrows 48 represent the adjustable directions for repositioning of bag rack 10.

Figure 7:
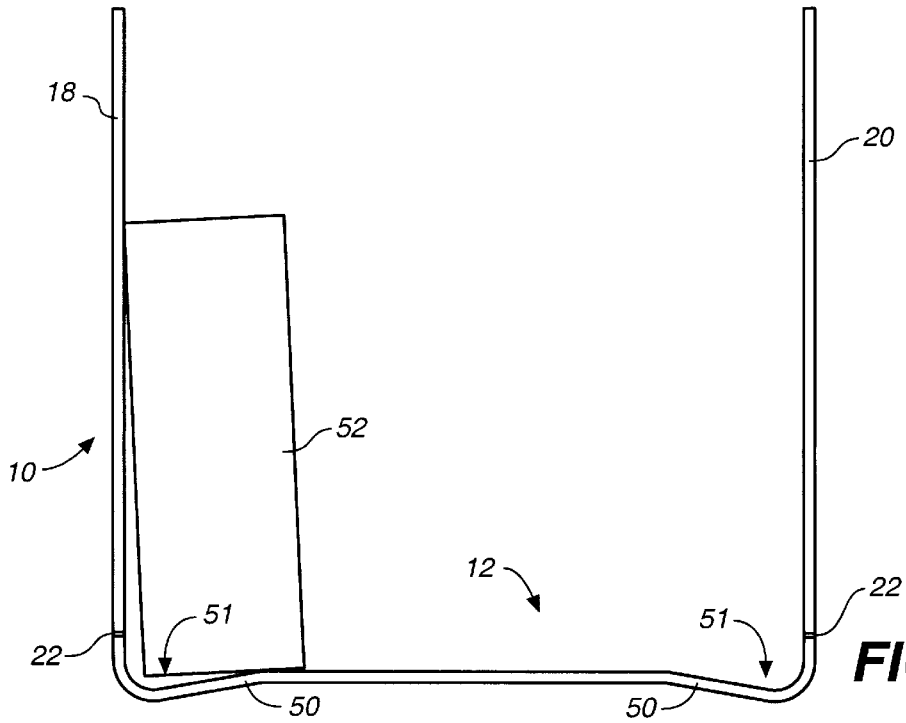
FIG. 7 is a cross-sectional view of an alternative embodiment of a bag rack with a trough formed around the perimeter of the base, shown with the side walls folded upwardly.

FIG. 7 shows a cross-sectional view of an alternative embodiment of a bag rack with the side walls folded upwardly. The perimeter of base 12 is formed with a downward slope 50 from adjacent the center of the base to the side walls 18, 20 and back wall 22. Slope 50 forms a trough 51 around the perimeter of base 12. The downward slope of the base tilts an item 52 placed at the perimeter of the base outwardly, against the side walls and back wall. This holds the items in place and prevents them from falling over into the bag as subsequent items are placed into the center of the bag.

Another embodiment of the bag rack of the present invention has a back wall extending upwardly from the base, with the base and the back wall joined and monolithically formed from a plastic material. In this embodiment, side walls are provided, but they may or may not be monolithically formed with the base or back wall. In either case, the side walls function to provide both containment of items and structural support to the back wall in order to maintain the bag support arms in position above the base as a bag is filled with items.

In both embodiments of the present invention, it is important that the base, the back wall, and the side walls be sufficiently imperforate to prevent displacement of the T-shirt bags outwardly of the planes of the base, the back wall and the side walls during filling. In this manner, the base, back wall and side walls provide containment of the bag as it is being filled.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

What is claimed is:

1. A bag rack for support of plastic T-shirt bags comprising:

a base having upwardly turned side, front and back edges for limiting outward displacement of a bottom of the bags during filling;

a back wall extending upwardly from the base;

left and right side walls, each extending between the back wall and the base, the side walls being open to a front of the bag rack for removal of filled bags from the bag rack from the front by lifting of the bags by an amount sufficient to pass over the upwardly turned front edge of the base;

a pair of spaced-apart bag support arms mounted to at least one of the side walls and the back wall, each bag support arm including an upper section extending above the base, cantilevered outwardly over the base, to position the upper arm sections for support of a T-shirt bag in a distended condition over the base for filling of the bag; and the side walls providing structural support to the back wall in order to maintain the bag support arms in position above the base as a bag is filled with items.

2. The bag rack of claim 1 wherein, the side walls and back wall are formed with hinge connector elements and can be positioned relative to the base in order to provide for efficient packaging of multiple bag racks; and the support arms releasably join the side walls and the back wall together.

3. The bag rack of claim 1 wherein, the left and right side walls diverge outwardly from each other in a direction from the back wall toward a front of the base.

4. A bag rack for support of plastic T-shirt bags comprising:

a base;

left and right side walls, a back wall extending upwardly from the base, the base and one of the side walls and back wall being monolithically formed from a plastic material, each left and right side wall extending between the back wall and the base, the side walls providing both containment of items and structural support to the back wall in order to maintain the bag support arms in position above the base as a bag is filled with items, the side walls defining an opening at a front of the bag rack for removal of filled bags therethrough;

a pair of spaced-apart bag support arms mounted to the back wall above the base and cantilevered outwardly over the base to position the arms for support of a T-shirt bag in a distended condition over the base for filling of the bag, the arms being formed from a metal and being sufficiently thin to enable mounting of the T-shirt bags thereto by mounting apertures provided in the T-shirt bags;

the back wall and side wall are sufficiently imperforate to prevent displacement of the T-shirt bags outwardly of the base, the back wall and the side wall during filling;

the base having an upwardly turned front edge; and the bag support arms are spaced apart a distance greater than a transverse width dimension of the base so that multiple bag racks can be stacked in a nested configuration.

5. The bag rack of claim 4 wherein, the back wall includes a mounting structure for adjusting the position of the bag rack.

6. The bag rack of claim 4 wherein, the left and right side walls diverge outwardly from the back wall toward a front of the base.

7. A bag rack for support of plastic T-shirt bags thereon during filling comprising:

a base having upwardly turned side edges and an upwardly turned rear edge;

a back wall extending upwardly from the base;

a pair of spaced apart bag support arms mounted to the back wall above the base and having lengths cantilevered outwardly from the back wall over the base by a distance sufficient for support of T-shirt bags having bottoms thereon in a distended condition for filling, the bag support arms having a relatively thin transverse cross section over substantially their entire lengths for sliding receipt of mounting apertures of T-shirt bags thereon to enable positioning and support of a plurality of T-shirt bags on the arms proximate the back wall; and the back wall including an opening adjacent the base for receiving the bottoms of the plurality of T-shirt bags supported on the bag support arms.

8. The bag rack as defined in claim 7 and wherein, the bag rack includes two side walls connected to the base and connected to the back wall and defining an open front of the bag rack.

9. The bag rack as defined in claim 7 wherein, the base, the back wall and side walls are sufficiently imperforate to prevent displacement of the T-shirt bags outwardly of planes passing through the base, the back wall and the side walls during filling; and the base has an upwardly arcuate front edge.

10. The bag rack as defined in claim 7 wherein, the back wall and the side walls are formed to receive and support removable bag support arms of different sizes.

11. A bag rack for support of plastic T-shirt bags comprising:

a base;

a back wall extending upwardly from the base and including a mounting structure for ergonomically adjusting the position of the bag rack;

left and right side walls, each extending between the back wall and the base, a pair of spaced-apart bag support arms joined to one of the side walls and the back wall, each bag support arm including an upper section extending above the base, cantilevered outwardly over the base, to position the upper arm sections for support of a T-shirt bag in a distended condition over the base for filling of the bag;

the side walls providing structural support to the back wall in order to maintain the bag support arms in position above the base as a bag is filled with items; and the side walls and the back wall are releasably joined together by the bag support arms.

12. A bag rack for support of plastic T-shirt bags comprising:

a base;

a back wall extending upwardly from the base;

left and right side walls, each extending between the back wall and the base, the side walls and back wall including slots for receiving bag support arms; and a pair of spaced-apart bag support arms mounted in the slots, each including an upper section extending above the base, cantilevered outwardly over the base, to position the upper arm sections for support of a T-shirt bag in a distended condition over the base for filling of the bag;

the side walls providing structural support to the back wall in order to maintain the bag support arms in position about the base as a bag is filled with items;

and wherein the side walls are hinged to the base in a manner allowing the side walls to pivot into parallel alignment with the base.

* * * * *